US006811052B2

(12) United States Patent
Barnett

(10) Patent No.: US 6,811,052 B2
(45) Date of Patent: Nov. 2, 2004

(54) DRINKING DEVICE LIFTED AND HELD BY A PERSON'S MOUTH

(76) Inventor: Wayne B. Barnett, 1252 Woodland Ct., Joliet, IL (US) 60436

( * ) Notice: Subject to any disclaimer, the term of this patent is extended or adjusted under 35 U.S.C. 154(b) by 82 days.

(21) Appl. No.: 10/354,861

(22) Filed: Jan. 30, 2003

(65) Prior Publication Data

US 2003/0111474 A1 Jun. 19, 2003

Related U.S. Application Data

(63) Continuation of application No. 09/949,473, filed on Sep. 7, 2001, now abandoned.

(51) Int. Cl.[7] ..... B65D 1/12
(52) U.S. Cl. ..... 220/703; 220/713; 222/490
(58) Field of Search ..... 220/703, 713, 220/490, 714, 711; 222/490

(56) References Cited

U.S. PATENT DOCUMENTS 860,501 A * 7/1907 Tatum ..... 220/703
2,076,132 A * 4/1937 Le Rose ..... 220/908 X
2,627,735 A * 2/1953 Dexter ..... 220/703
5,755,354 A * 5/1998 Lang ..... 220/703 X
5,791,510 A * 8/1998 Paczonay ..... 220/703 X

* cited by examiner

*Primary Examiner*—Joseph Man-Fu Moy
(74) *Attorney, Agent, or Firm*—Cherskov & Flaynik

(57) ABSTRACT

A drinking device 10 lifted and held by a person's mouth while the person consumes the liquid contents includes a lower base portion 12, an upper mouth portion 14 having an aperture 15 in a top portion 17, and a mid-portion 16 having a relatively cylindrical outer wall 18 integrally joined to the lower base portion 12 and the upper mouth portion 14. The upper mouth portion 14 includes a relatively arcuate first side ridge 35 positioned adjacent to a horizontal portion 33 of an upper end 32 of the outer wall 18, and a substantially right angled second side ridge 36 positioned substantially opposite the first side ridge 34 and adjacent to an arcuate portion 35 of the upper end 32 of the outer wall 18. The aperture 15 is positioned in axial alignment with the outer cylindrical wall 18 of the mid-portion 14.

20 Claims, 3 Drawing Sheets

FRONT

BACK

TOP

SIDE

Bottom

DRINKING DEVICE LIFTED AND HELD BY A PERSON'S MOUTH

This is a continuation application from U.S. patent application No. 09/949,473, filed Sep. 7, 2001 now abandoned.

BACKGROUND OF THE INVENTION

1. Field of the Invention

The present invention relates generally to drinking devices and, more particularly, to drinking devices that are lifted and held by a person's mouth while the person consumes the liquid contents of the device, 2. Background of the Prior Art Liquid are consumed by individuals from a myriad of containers designed for people having the use of their hands. These containers vary in size, configuration and materials of fabrication and include cups, glasses and plastic bags, all requiring a person to hold some portion thereof in their hand while they consume the contents. Further, these containers generally include large apertures defined by a cylindrical wall that determines the volume of the container, although a cover may be placed upon some of these containers to prevent spillage. An orifice is sometimes included in the cover to removably receive a straw therein to allow a person to drink from a covered container.

None of the aforementioned designs are capable of being lifted by only a person's mouth. However, even if a person were capable of lifting one of the containers with their mouth, the person would not be able to drink the liquid contents of the container because the container cannot be positioned by a person's mouth such that a base portion of the container is level with or above the aperture of the container. Further, drinking difficulties are amplified due to the large size of the aperture in relation to the size of the container. The conventional aperture would allow excessive liquid flow from the container into the person's mouth, should the person somehow be able to position the container to consume the liquids therein. The excessive liquid flow could result in the choking of the person while he or she tried to drink the contents of the container.

A need exists in the art for a drinking device that allows a person with only the use of their mouth, to lift, hold and position the device, while at the same time safely consuming a limited liquid flow therefrom.

SUMMARY OF THE INVENTION

It is an object of the present invention to provide a drinking device that is lifted and held by a person's mouth thereby overcoming many of the disadvantages of the prior art.

A principal object of the present invention is to provide a drinking device that allows a person, without the use of their hands, to grasp the device with their upper and lower incisor teeth and lift the device. A feature of the device is an upper mouth portion with first and second opposing ridges having side walls configured to engage the upper incisor and canine teeth of the upper jaw, and the lower incisor teeth of the lower jaw. An advantage of the device is that it is easily lifted by a person's mouth and held in a relatively horizontal position when the person raises the device to a substantially vertical position.

Another object of the present invention is to allow the device to be elevated such that the base portion can be raised above the mouth portion to quickly drain the contents from the device. A feature of the device is an indented surface that integrally joins with the first ridge, and extends to a position adjacent to a top portion of the upper mouth portion. An advantage of the device is that a person is capable of raising the base portion, without tilting their head backwards, by positioning their lower incisor teeth upon the indented surface near the top portion, simultaneously placing their lower lip against a side wall of the first side ridge, and sliding their lower incisor teeth toward the first side ridge while engaging the indented surface.

Yet another object of the present invention is to stabilize the device with their mouth when holding and drinking the contents of the device. A feature of the device is a substantially planer back portion that engages an internal upper portion of the person's mouth. An advantage of the device is that it will not rotate inside the person's mouth when the person starts to consume the contents of the device.

Another object of the present invention is to restrict the flow of liquid from the device into a person's mouth. A feature of the device is an aperture having a diameter about half the diameter of an outer wall of a cylindrical mid-portion of the device. An advantage of the device is that it prevents an excessive amount of liquid from flowing into a person's mouth while the person is swallowing the liquid thereby preventing the person from choking.

Another object of the present invention is to balance the weight distribution of the device when the device is horizontally positioned. A feature of the device is a relatively oval or elliptically configured upper mouth portion that includes a top portion separated from an upper end of the mid-portion, a distance that is relatively larger than the axial dimension of the mid-portion of the device. An advantage of the device is that the weight of the portion of the device inside the person's mouth, is substantially equal to the weight of the portion of the device outside the person's mouth.

Briefly, the invention provides a drinking device lifted by a person's mouth comprising a lower base portion; an upper mouth portion; and a relatively cylindrical outer wall integrally joined to said lower base portion and said upper mouth portion, said upper mouth portion further comprising a first side ridge positioned adjacent to an upper end of said outer wall; a second side ridge positioned substantially opposite to said first side ridge; and an aperture in said upper mouth portion.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
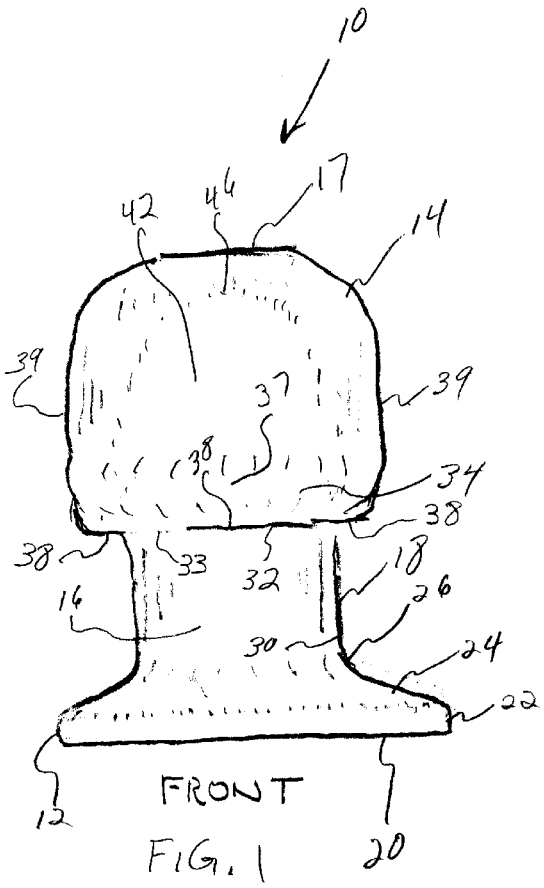
FIG. 1 is a front elevation view of a drinking device lifted and held by a person's mouth in accordance with present invention.

Referring now to the drawings and in particular to FIGS. 1–5, front, back, side, top and bottom elevation views of a drinking device lifted and held by a person's mouth while the person consumes the liquid contents in accordance with the present invention, is denoted by numeral 10. The drinking device 10 includes a lower base portion 12, an upper mouth portion 14 having an aperture 15 in a relatively planer top portion 17, and a mid-portion 16 having a relatively cylindrical outer wall 18 integrally joined to the lower base portion 12 and the upper mouth portion 14. The drinking device 10 may be fabricated from any non-porous material including but not limited to metal, plastic, glass and porcelain, or combinations thereof.

The base portion 12 is solidly constructed and cylindrically configured, and includes a planar bottom wall 20, a relatively "short" side wall 22, and a relatively arcuately upward sloping top wall 24 that integrally joins with a lower end 26 of the cylindrical outer wall 18 of the mid-portion 16. The diameter of the bottom wall 20 and the length of the side wall 22 are dimensioned to add sufficient weight to the base 12 of the device 10 to provide substantial "ballast" which stabilizes the device 10 and reduces the possibility of spillage when a person begins lifting the device 10 with their mouth. Empirical evaluations have determined that the diameter of the bottom wall 20 should be substantially about two-thirds the overall height of the drinking device 10 to provide stability without making the base excessively heavy and causing difficulty to the individual lifting and holding the device.

The mid-portion 16 is essentially a hollow tube having a cavity 28 configured by an inner cylindrical wall 30 that cooperates with the outer wall 18 to establish the "thickness" of the tubular wall. The diameter of the mid-portion 16 is substantially about one-half the diameter of the base 12 to maintain the device in a substantially vertical position. The axial dimension of the mid-portion 16 corresponds to a predetermined volume of liquid to be contained by the mid-portion 16. However, the longer the axial dimension of the device 10, the less stable the device 10. Should an excessively large volume of liquid be required with a corresponding long axial dimension, a base 12 having a relatively long lateral side wall 22 would be utilized to provide increased weight in the base 12 thereby providing more ballast and stability to the device 10. The mid-portion 16 integrally joins to the upper mouth portion 14 via an upper end 32 of the outer wall 18.

Figure 2:
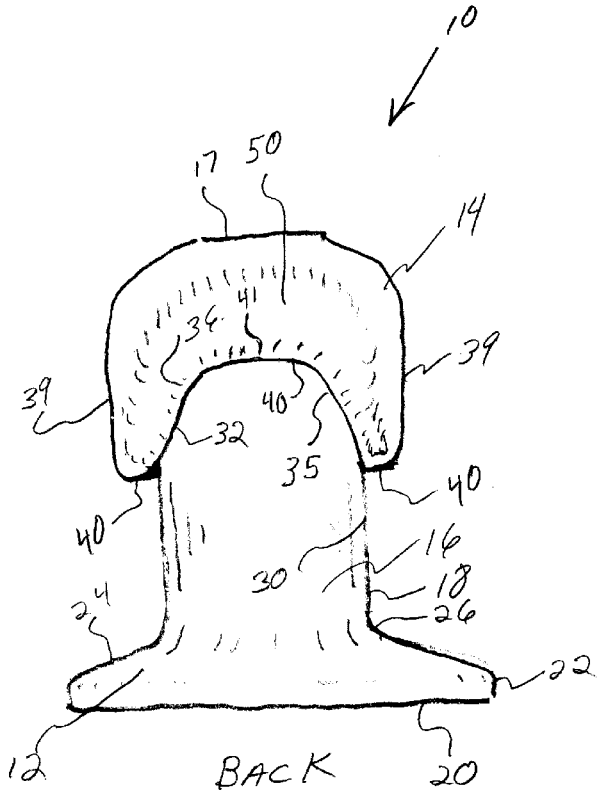
FIG. 2 is a back elevation view of the drinking device depicted in FIG. 1.
Figure 4:
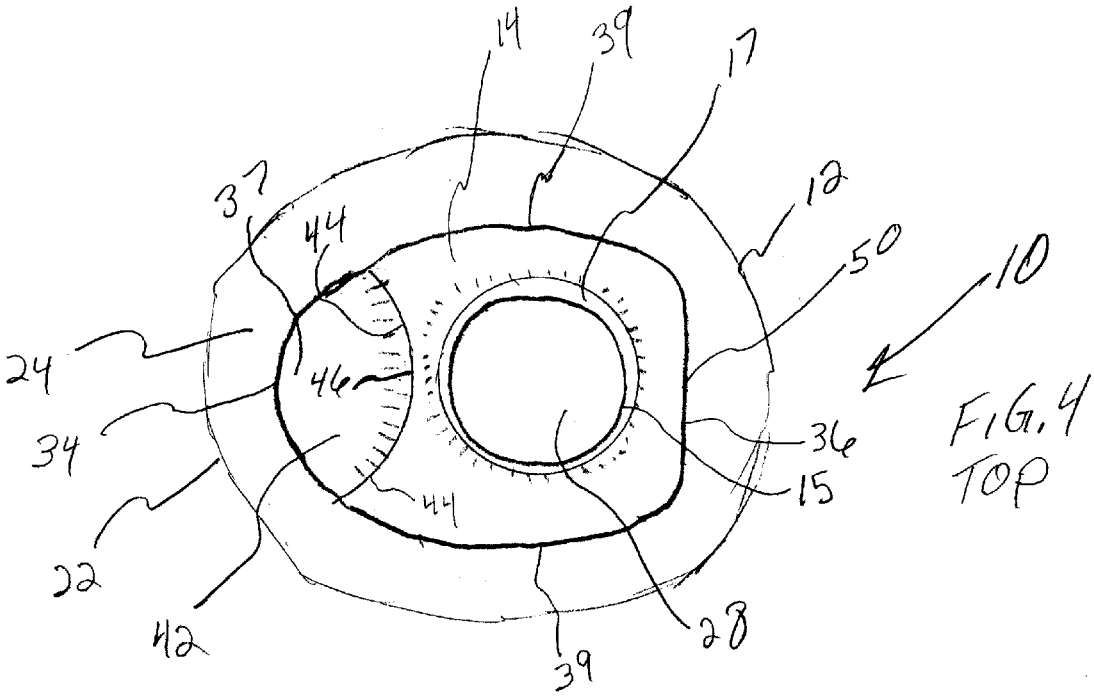
FIG. 4 is a top elevation view of the drinking device depicted in FIG. 1.
Figure 3:
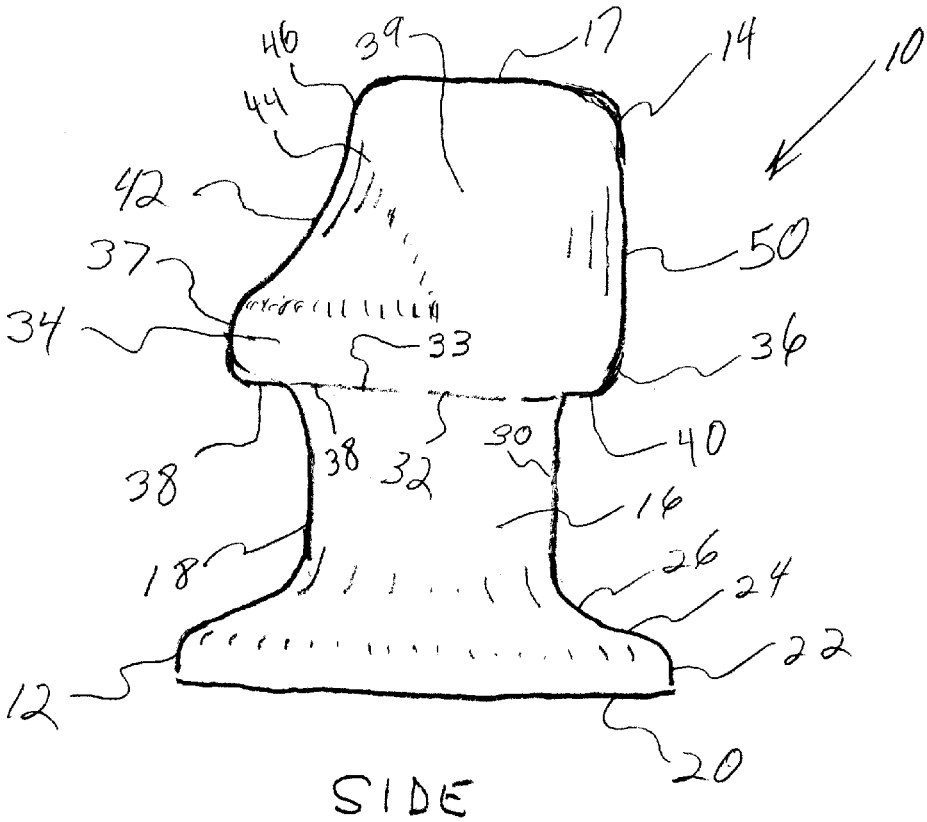
FIG. 3 is a side elevation view of the drinking device depicted in FIG. 1.

Referring to FIGS. 2, 3 and 4, the upper mouth portion 14 includes a relatively arcuate first side ridge or annulus segment 34 positioned adjacent to a horizontal portion 33 of the upper end 32 of the outer wall 18, and a substantially right angled second side ridge or annulus segment 36 positioned substantially opposite the first side ridge 34 and adjacent to an arcuate portion 35 of the upper end 32 of the outer wall 18. The mouth portion 14, when taking a front view of the device 10, is substantially oval or elliptically configured and positions the aperture 15 in axial alignment with the outer wall 8, although the shape of the mouth of a person using the device 10 may require an aperture to be positioned in a non-axial alignment configuration. The aperture has a diameter substantially about one-half the diameter of the outer wall 18 to reduce the flow of liquid from the device 10 into a person's mouth to prevent an excessive amount of liquid from flowing into the person's mouth while the person is swallowing the liquid thereby preventing the person from choking.

Figure 5:
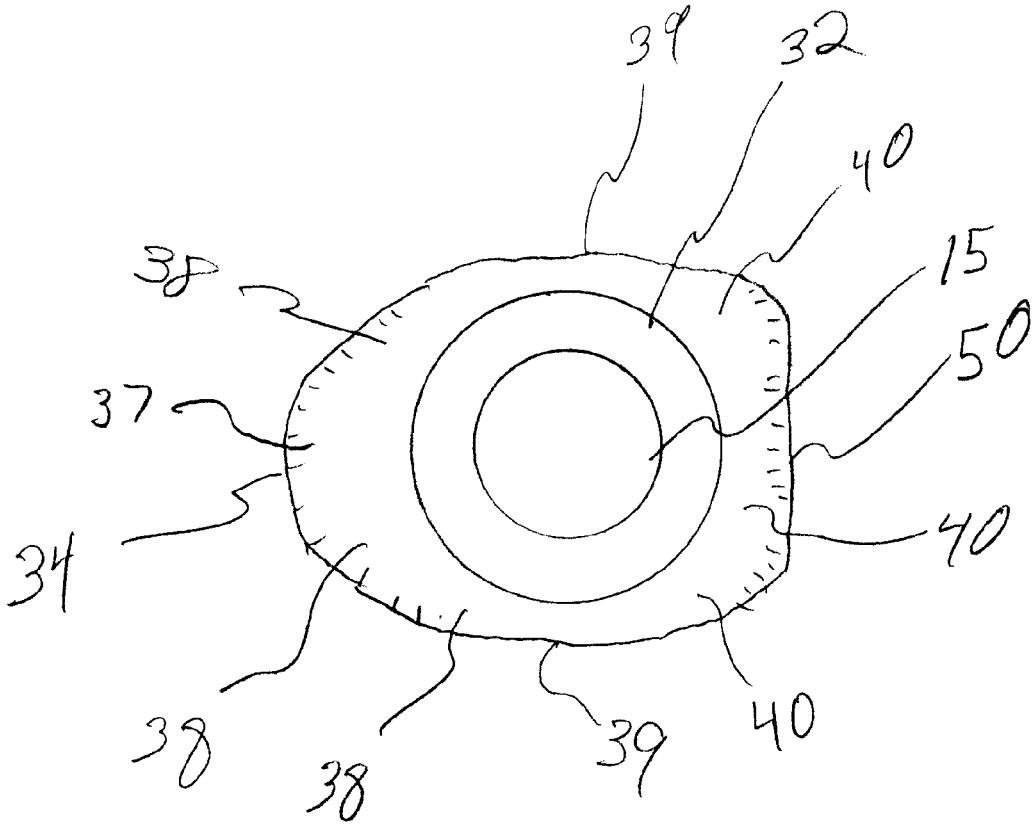
FIG. 5 is a bottom elevation view of the upper mouth portion detached from the mid-portion of the device depicted in FIG. 1.

Referring to FIGS. 1, 2 and 5, the first side ridge 34 includes an annular configured, when viewing the drinking portion 14 from the bottom, planar first side ridge side wall 38 that is perpendicular and integrally joined to the outer wall 18. The first side ridge side wall 38 enables the first side ridge 34 to extend radially around substantially about half the perimeter of the outer wall 18, and ultimately join with arcuate side surfaces 39 of the drinking portion 14. The first side ridge side wall 38 includes predetermined lateral and radial dimensions that allow an individual to engage their lower jaw's four incisor teeth and their lower lip with the side wall 38 at a front portion 37 of the first side ridge 34 to ultimately lift and hold the device 10.

The second side ridge 36 engages a relatively shorter perimeter portion of the outer wall 18 in comparison to the first side ridge 34, and ultimately joins with the arcuate side surfaces 39 of the drinking portion 14. The second side ridge side wall 40 protrudes perpendicularly from the outer wall 18, a distance relatively smaller than the perpendicular protrusion of the first side ridge side wall 38 thereby establishing the first side ridge 34 as the primary lifting ridge of the device 10. The second side ridge 36 and second side ridge side wall 40 are arcuately configured, when taking a back elevation view of the device 10. The second side ridge side wall 40 includes predetermined lateral and arcuate dimensions that allow an individual to engage their upper jaw's four incisor and two canine teeth, and their lower lip with the side wall 40 at an arcuate portion 41 of the second side ridge 36. The first and second side ridge side walls 38 and 40 cooperate to allow an individual to ultimately lift, hold and pivot the device 10 in the individual's mouth to consume the liquid contents therein. The side walls 38 and 40 further cooperate to allow the individual, after consuming the device's contents, to lower the device 10 until the base 12 of the device 10 is set upon a supportive surface. Although described above as being arcuately configured, the second side ridge 25 side wall 40 may be crescent shaped, a planer ring (similar to the first side wall 38) or an inverted "V" shape should the individual's jaw and teeth construction require varying the side wall 40 configuration accordingly.

Referring to FIGS. 1, 3 and 4, the upper mouth portion 14 further includes an indented or sloping surface portion 42 that integrally joins to the first side ridge 34 and extends to a position adjacent to the top portion 17 of the upper mouth portion 14. The indented portion 42 extends arcuately across the mouth portion 14, when taking a top view of the device 10, such that a crescent configuration 44 is formed that positions an apex 46 nearly tangent to the top portion 17. The indented portion integrally joins with the two arcuate side surfaces 39 of the upper mouth portion 14 such that a continuous oval or ellipsoid surface is configured that cooperatively engages the inner lower mouth of an individual lifting the device 10. The indented portion 42 receives the lower jaw's incisors thereupon and allows the base 12 of the device 10 to be elevated above the mouth portion 14 by maintaining the lower lip upon the first side ridge side wall 38, moving the lower jaw inward to position the incisors upon the indented portion 42, forcing the lower jaw outward while maintaining the lower jaw horizontal and the incisors upon the indented portion 42, and maintaining the position of the upper incisors that are engaging the second side ridge side wall 40. The distance of extension of the lower jaw toward the first side ridge 34, dictates the degree of elevation of the base 12 above the upper mouth portion 14, which correspondingly controls the rate of flow of the liquid contents of the device 10 into the mouth of the individual. Thus, the quantity of liquid received by the individual per unit of time is directly controlled by the movement of a person's lower jaw in relation to the first side ridge 34, thereby allowing the person to drink the device's 10 contents without choking and without the use of hands.

Referring to FIGS. 1, 2 and 4, the upper mouth portion 14 also includes a relatively planar back portion 50 that integrally joins to the second side ridge 36 and extends to a position adjacent to the top portion 17 of the upper mouth portion 14. The planer back portion 50 is positioned opposite to the indented portion 42, and extends across the back side of the upper mouth portion 14 to integrally join with the side surfaces 39 of the mouth portion 14 such that a continuous surface is configured that cooperatively engages corresponding portions of the mouth of an individual lifting the device 10. The planer surface 48 contacts the roof of the mouth of an individual drinking from the device 10 thereby providing added engagement area between the individual's mouth and the device 10 to further stabilize the device 10 while the contents are being consumed.

In operation, the device 10 is filled with a liquid and positioned upon a solid surface near a person without the use of their hands. The device 10 is positioned such that the front side of the device 10, which includes the indented portion 42, faces the person. The person bends over and grasps the device 10 such that their lower incisor teeth in their lower jaw engage the first side ridge side wall 38, and their upper incisor and canine teeth in their upper jaw engage the second side ridge side wall 40. The person then returns to a substantially vertical position thereby placing the device 10 in a relatively horizontal position allowing the contents to flow into the person's mouth via the aperture 15 in the top portion 17 of the drinking portion 14. To completely drain the device, the person slides their lower incisors upon the indented portion 42 toward the top portion 17, while simultaneously placing their lower lip against the first side ridge side wall 38, then slides their lower incisors toward the first side ridge 34 until the lower incisors engage a mid-portion of the ridge 34 thereby elevating the lower base portion 12 above the upper drinking portion 14 to quickly drain the liquid contents of the device 10. After consuming the contents of the device 10, the person then slides their lower incisors to their original position of engagement with the first side ridge side wall 38, while maintaining the position of the upper incisors against the second side ridge side wall 40. The person then bends over to lower device 10 until the base portion 12 engages the solid surface thus vertically positioning the device 10 with it's front side once again facing the person.

What is claimed is:

1. A non-deformable drinking device lifted by a person's mouth comprising:

a lower base portion;

an upper mouth portion; and a relatively cylindrical outer wall integrally joined to said lower base portion and said upper mouth portion;

said upper mouth portion further comprising:

a substantially oval configured top portion;

an aperture in said oval configured top portion;

a first side ridge positioned adjacent to an upper end of said outer wall, said first said ridge being radially disposed about a longitudinal axis of said device; and a second side ridge positioned substantially opposite to said first side ridge, said second side ridge being disposed so as to form a non-radial are relative to the longitudinal axis of said device, said first and second side ridges protruding from said outer wall to facilitate a person's lips and teeth to lift and position said device whereby all the contents in said device may ultimately be consumed.

2. The drinking device of claim 1 wherein said lower base portion is substantially cylindrically configured with a diameter relatively larger than the diameter of said relatively cylindrical outer wall.

3. The drinking device of claim 1 wherein said first side ridge extends radially around substantially around half the perimeter of said upper mouth portion.

4. The drinking device of claim 1 wherein said first side ridge is arcuately configured.

5. The drinking device of claim 1 wherein said first side ridge integrally joins to said second side ridge.

6. The drinking device of claim 1 wherein said first side ridge includes a first side ridge wall perpendicular and integrally joined to said outer wall, said first side ridge side wall extending a first distance from said outer wall.

7. The drinking device of claim 1 wherein said second side ridge includes a second side ridge side wall perpendicular and integrally joined to said outer wall, said second side ridge side wall extending a second distance from said outer wall.

8. The drinking device of claim 1 wherein said second side ridge includes a crescent configuration when taking a back view of said drinking device.

9. The drinking device of claim 1 wherein said second ridge includes an arcuate configuration when taking a back view of said drinking device.

10. The drinking device of claim 1 wherein said second side ridge includes a substantially V shaped configuration when taking a back view of said drinking device.

11. The drinking device of claim 1 wherein said aperture includes a diameter that is substantially about half the diameter of said outer wall.

12. The drinking device of claim 1 wherein said aperture is axially aligned with said outer wall.

13. The drinking device of claim 1 wherein said aperture aligned with said outer wall.

14. The drinking device of claim 1 wherein said upper mouth portion includes an indented portion integrally joined to said first side ridge.

15. The drinking device of claim 1 wherein said upper mouth portion includes a planar portion integrally joined to said second side ridge.

16. A drinking device for a person without the use of their hands comprising:

a base;

a column having a predetermined volume;

a top portion having a centrally disposed aperture; and an upper portion having a first side annulus segment for engaging a plurality of lower teeth of the person, said first side annulus being radially disposed about a longitudinal axis of said device, a second side annulus segment for engaging a plurality of upper teeth of the person, said second side annulus being disposed so as to form a non-radial are relative to the longitudinal axis of said device, said first and second side annulus segments protruding from an outer wall of said column to facilitate a person's lips and teeth to lift and position said device whereby all the contents in said device may ultimately be consumed.

17. The device of claim 16 wherein said first side annulus segment is relatively larger than said second side annulus segment.

18. The device of claim 16 wherein said upper portion is oval configured when taking a front view of the device.

19. A rigid drinking device for a person that has lost the use of their hands comprising:

a base;

a column having a cylindrical outer wall; and an upper mouth portion having an aperture therein, said upper mouth portion including means for facilitating a person's lips and teeth to lift and position said device whereby all the contents in said device may ultimately be consumed, said facilitating means comprising a first side ridge being radially disposed about a longitudinal axis of said device, and a second side ridge being disposed so as to form a non-radial are relative to the longitudinal axis of said device.

20. The device of claim 19 wherein said upper mouth portion includes an oval configuration.

* * * * *